US006504445B1

(12) United States Patent
Kocharyan

(10) Patent No.: US 6,504,445 B1
(45) Date of Patent: Jan. 7, 2003

(54) SURFACE MOUNTABLE LOW IMD CIRCULATOR/ISOLATOR WITH A LOCKING COVER AND ASSEMBLY METHOD

(75) Inventor: Karen Kocharyan, Somerville, MA (US)

(73) Assignee: Renaissance Electronics Corporation, Harvard, MA (US)

( * ) Notice: Subject to any disclaimer, the term of this patent is extended or adjusted under 35 U.S.C. 154(b) by 0 days.

(21) Appl. No.: 10/005,520

(22) Filed: Dec. 7, 2001

(51) Int. Cl.[7] ..... H01P 1/387; H01P 1/36
(52) U.S. Cl. ..... 333/1.1; 333/24.2
(58) Field of Search ..... 333/1.1, 24.2; 174/52.5; 361/783; 257/704, 726, 727; H01P 1/36, 1/38, 1/383, 1/387

(56) References Cited

U.S. PATENT DOCUMENTS

| | | | | | |
|---|---|---|---|---|---|
| 3,621,476 | A | * | 11/1971 | Kanbayashi | 333/1.1 |
| 3,673,518 | A | * | 6/1972 | Carr | 333/1.1 |
| 3,873,757 | A | * | 3/1975 | Berke et al. | 174/52.1 |
| 6,011,449 | A | * | 1/2000 | Jussaume et al. | 333/1.1 |
| 6,218,611 | B1 | * | 4/2001 | Bias | 174/35 GC |

* cited by examiner

*Primary Examiner*—Justin P. Bettendorf

(57) ABSTRACT

A structure for a low IMD passive microwave device, adapted for automated assembling and placement. The structure includes sheet metal housing having a bottom portion and a plurality of sides that are bent at 90-degree angle to the bottom portion. In each side there is a flare slot that can receive a tooth of a teeth cover. The structure has the aligning holes, slots and reference points on the entire stack to facilitate and automate the assembly process in manufacturing. The tuning stub resonators of a center conductor have the extended peripheral portions with the aligning half-moon holes. Those extended portions provide the condition when the operation range is maximally separated from the resonant frequency, thus providing the condition for the lower IMD. The housing is attached to a PCB. The input/output ports are formed on the PCB with the contact pads situated on both sides that are electrically connected using the PTHs. The center conductor arms are connected to the pads on the housing side of the PCB. The structure is installed on the customer's system board with the electrical connections provided by the bottom side of the PCB. Since all electrical contacts are formed on the same part using the same face of the PCB, the required coplanarity and flatness are inherently maintained allowing the implementation of an automated pick-and-place process at installation.

8 Claims, 3 Drawing Sheets

SURFACE MOUNTABLE LOW IMD CIRCULATOR/ISOLATOR WITH A LOCKING COVER AND ASSEMBLY METHOD

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

The present invention relates generally to the microwave ferrite devices, and particularly to the design of ferrite circulators/isolators that provide the suppression of intermodulation distortion (IMD), include coplanar mounting portion, and allow the application of pick-and-place technology both in production and installation. More specifically, the present invention relates to the structure of circulator/isolator operating above the ferromagnetic resonance. It includes the shape of the central conductor, the housing and installation base, and the assembly procedure for the entire structure.

Increasing demands for high signal power and bandwidth capacity in modern communication networks imposes stronger limitations to the allowed level of IMD. In many cases the typical level of IMD~−75 dBc measured in the existing high power circulators is not sufficient for providing the required inter-channel isolation. The suppression of IMD decreases the interference between the adjacent communication channels and leads to the higher quality of operation. Therefore, the development of a circulator/isolator that is capable of handling high input power while maintaining a low signal distortion is of crucial importance.

The major contributor to IMD in microwave ferrite devices, such as circulators/isolators, is the non-linear phenomenon of ferromagnetic resonance. The closer is the frequency of ferromagnetic resonance (FMR) to the operation range the larger will be the signal distortion. Another contributor to the IMD is a non-uniform design. This means that the more portions of different conducting materials are used in the design, the worse is a device in terms of IMD. Therefore, the efficient suppression of IMD may be achieved by using the similar conducting materials in the signal path and by providing the design allowing the operation of circulator/isolator with high FMR frequency offset.

The operation above the ferromagnetic resonance is realized when the biasing magnetic field sets the frequency of magnetic resonance above the operation range. The magnetized ferrite produces the rotation of the field that creates the circulation action used in the non-reciprocal ferrite devices, such as circulators/isolators. The amount of rotation depends on the anisotropic splitting factor $k/\mu$, where $\mu$ and k denote the diagonal and off-diagonal components of the ferrite relative permeability tensor. The typical variation of anisotropic splitting factor with frequency is shown for two values of the external biasing magnetic field, $H_1$ and $H_2$ ($H_1<H_2$). Denoting the range of circulator operation as $f_{oper}$, and the frequencies of ferromagnetic resonance corresponding to the biasing fields $H_1$ and $H_2$ as $f_1$ and $f_2$ respectively, we get the equation:

$$f_{ri}=\gamma H_i,\ (i=1,2)$$

where $\gamma$=2.8 MHz/Oe is the gyromagnetic ratio.

The major contributor to IMD in ferrite devices is the non-linear response of circulator to the external RF field, which follows from the fundamental non-linearity of the magnetic moment motion. This non-linear term is inversely proportional to the spacing factor, $|f_r^2-f_{oper}^2|^{-1}$. One can see that the efficient suppression of IMD can be achieved by increasing the frequency offset, $f_r-f_{oper}$, or, otherwise, by incrementing the biasing field from $H_1$ to $H_2$. However, the field enhancement shifts the whole curve toward higher frequencies and at the given operation frequency band reduces the splitting factor from its nominal value that produces 30-degree turn of the standing wave pattern. In the conventional center conductor designs the input quarter-wave transformer arms are usually used for impedance matching purposes, and the open-end stub resonators including some of the central area—to get the specific frequency characteristics. However, the shape of the open stub resonators intended for enhanced magnetic field operation is not defined.

Rapid expansion of communication networks and base stations sharply increased demands for the low cost circulators/isolators intended for high power applications. This application presumes the design that allows the attachment of circulators/isolators to the customer's system, usually a printed circuit board (PCB) using surface mount technology. In order to ensure the reliable electrical contact with the customer's system and to use effectively the pick-and-place technology, the connecting leads and the mounting base of a circulator/isolator have to be rigid and flat (usually the overall flatness of the mounting base should be within 4 mils).

With all of the above-mentioned features, the circulator/isolator should be inexpensive. Keeping the cost as low as possible in the large-scale production implies the usage of simple mechanical design that is compatible with automated pick-and-place assembling and mounting technology.

Thus, both electrical and mechanical portion of the design should be suitable for application of pick-and-place method both in assembling and at installation, and should provide high reliability, low IMD and the low cost. In order to enable the use of surface mount technology it is very important to maintain the coplanarity between all contacting surfaces that include both the ground plane and the ports.

The surface mount circulators/isolators are already known (see, for example, U.S. Pat. No. 6,011,449). The known devices include a housing having flat bottom and circumferential side portions with openings. Electrical conductors of a central junction extend from the openings onto substantially rigid supports. The conductors are positioned above the supports and are electrically connected to contacts, which are secured in and go down through apertures formed in the supports. Each contact is isolated from the support by a dielectric material. The output end of the contacts and the bottom surface of the housing have to be kept coplanar. However, it is difficult to provide tight tolerance coplanarity in such design because all contacts are made by different constructive parts of the structure.

Relatively simple structure of circulators/isolators, that includes an inexpensive sheet metal housing bent to shape (no machining) is also known (see, for example, U.S. Pat. No. 3,621,476). In this structure the required pressure on the ferrite-center conductor-magnet component stack over the operating temperature range is applied by a pressure plate made of a silicon rubber that is disposed inside the housing. This pressure plate is "an extra part" that increases the size of the device and diminishes the magnetic flux. In some other known structures the pressure is applied by using a cover with a concave surface. But because of such surface's high rigidity the concave does not perform satisfactory as a spring element, especially in the small devices, and tends to crack ferrites under an excessive pressure with the temperature variation.

The center conductor in known devices is usually shaped to match the circulator's impedance to that of a transmission line. The tuning elements comprise of the quarter-wave transformer arms as well as of the open-end tuning stub resonators symmetrically situated between the arms (see, for example, U.S. Pat. No. 3,673,518). Impedance matching provides a smooth passage of microwave energy between the corresponding circulator ports. The experiments have demonstrated that the shaping of the center conductor is also important for achieving the low IMD level.

Accordingly, the objective of the present invention is an inexpensive high power circulator/isolator structure with improved IMD and temperature performance, having a simple sheet metal housing and coplanar mountain surface, and allowing the utilization of automated assembling and installation technique.

BRIEF SUMMARY OF THE INVENTION

In accordance with the present invention the center conductor is reshaped to meet a low IMD. In order to compensate the decrease of the splitting factor introduced by the field enhancement, the coupling between the center conductor and the ferrites is increased. This is achieved by increasing the area of open-ended tuning stub resonators. Because the efficiency of coupling dramatically increases at the periphery of the ferrites, the highest coupling and, correspondingly, the lowest IMD is achieved by the maximum extension of the tuning stub resonators toward the edges of the ferrites in radial direction, and toward the transformer arms in azimutal direction. In addition, the centering tabs are formed on the resonator portion extending beyond the ferrite outline. This allows improving the alignment of center conductor with respect to the ferrites, if which, in turn, further improves the performance of the unit.

The housing according to the present invention is formed of a sheet metal as a polygonal structure and includes a bottom portion and a plurality of side portions separated from each other and bent perpendicular to the bottom. On the bottom portion at least three radial centering slots and at least three relief openings are symmetrically disposed in the spaces between the side portions. Each side portion has a flare slot that is open at one end. One side of this slot that is closest to the bottom is parallel to the bottom surface. The housing is secured, for example, by soldering to the printed circuit board (PCB) having at least three centering holes. Centering slots in the housing bottom portion coincide with the centering holes in the PCB.

Inside the housing a stack of components such as ferrites, a center conductor, a magnet(s), pole pieces, ground plates, temperature compensators (the usual stack for circulators/isolators) is disposed. All the components of the stack according to the present invention have the same size outline (for example, the same diameter). The stack is closed by a polygonal cover, which has at least the same number of sides as the housing. The stack and the polygonal cover are held in place in the housing by a locking cover having radial teeth that are received by the flare slots in the housing's side portions.

The structure according to the present invention can be easily assembled using a simple fixture having a base and three pins that are secured in the base. During the assembly process the housing with the PCB are installed in the fixture. The pins go through the holes in the PCB and slots in the bottom portion of the housing. The length of the pins over the fixture's base is slightly shorter than the height of the stack that, in turn, being completed with the polygonal cover is a little high than the lowest side of the flare slots in the side portions of the housing. Being disposed in the housing the stack of components is centered and aligned by the pins. The locking cover in the assembly process is turned in the flare slots until the proper pressure on the stack is achieved (can be controlled by a torque wrench). After that the assembled circulator/isolator is removed from the fixture.

The PCB has a central portion and three ports for a circulator or two ports for an isolator (where one arm of the center conductor is terminated by a resistor). All ports are extended from the central portion and have copper pads on both sides. According to the present invention the center conductor arms are secured (for example, by soldering) to the port pads on the PCB's side facing the housing. These pads are connected with the pads situated on the opposite side of the PCB (bottom pads) using the plated through holes (PTH). The circulator/isolator is connected to the system lines by means of the bottom pads. The PCB also has a plurality of PTHs in the central portion. The grounding to the unit and the heat transfer from the unit are provided by those PTHs.

In operation, when the temperature variation causes the locking cover teeth to bend, the change of the load applied to the stack remains almost the same. This results from the small cross-section area of the teeth as compared with the diametrical cross-section of the cover. Therefore, the spring action may be realized with the teeth only, while the cover is strong enough in terms of the rigidity and thick to allow the proper completion of the magnetic loop.

Thus, the structure according to the present invention is a low IMD passive RF device, such as circulator/isolator having a sheet metal housing, a flat locking cover without any thread (no machining), and a PCB used as a common and uniform mounting base.

It is an object of the present invention to have a structure having center conductor that allows predetermined IMD and impedance control.

It is a further object of the present invention to have a structure with only one constructive part defining the flatness of the installation surface.

It is a further object of the present invention to have a simple housing and covering elements structure that can be made of sheet metal substantially by stamping and without any secondary machining.

It is a further object of the present invention to have a structure that can be easily assembled using the simplest fixture that provides the centering and the alignment of all the stack components simultaneously with respect to each other and to the housing.

It is an advantage of the present invention to have a temperature variation compensating structure without the usage of any "extra" spring components in the stack.

It is another advantage of the present invention to have a flat mounting base with tight tolerance that allows the usage of the pick-and-place technological process.

DETAILED DESCRIPTION OF THE INVENTION

Figure 1:
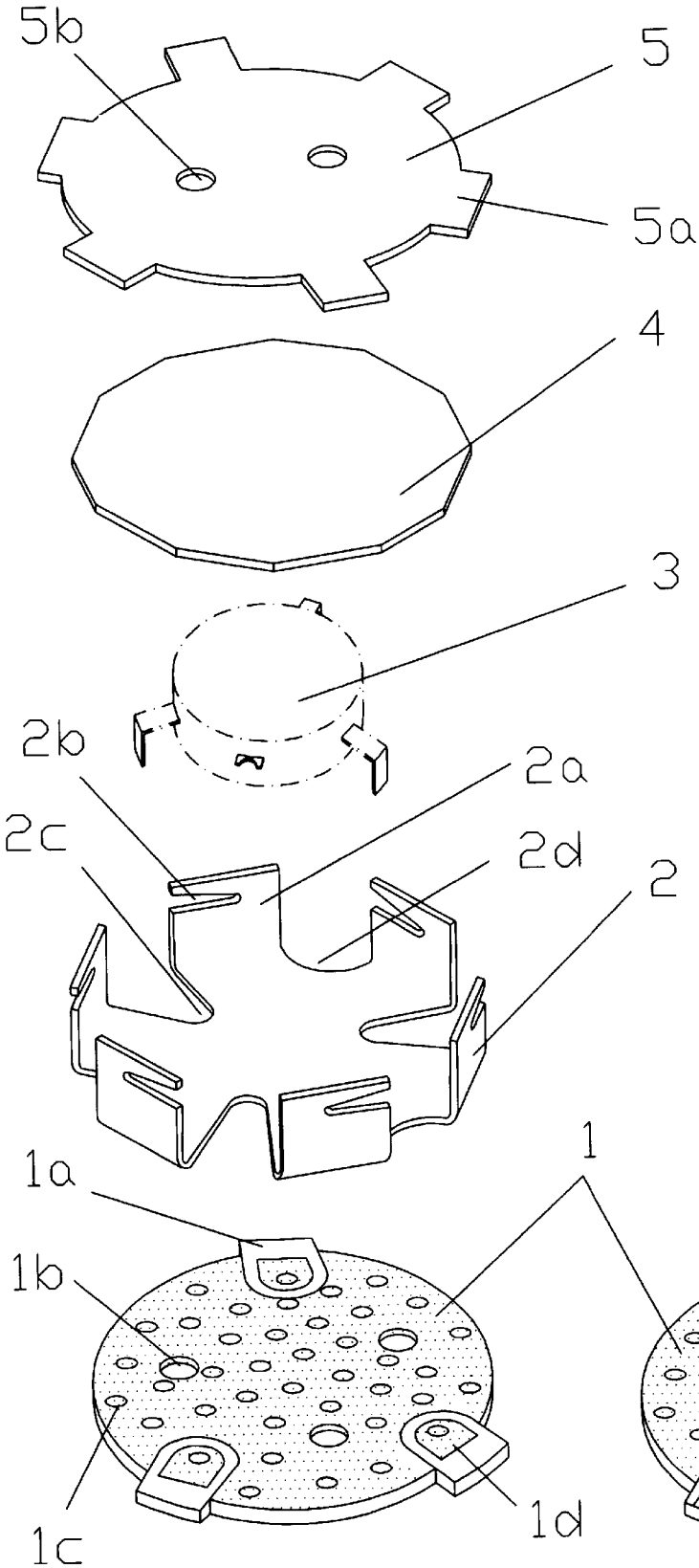
FIG. 1 shows an exploded perspective view of the structure according to the present invention (for clarity, the stack of components is shown as one solid portion).
Figure 2:
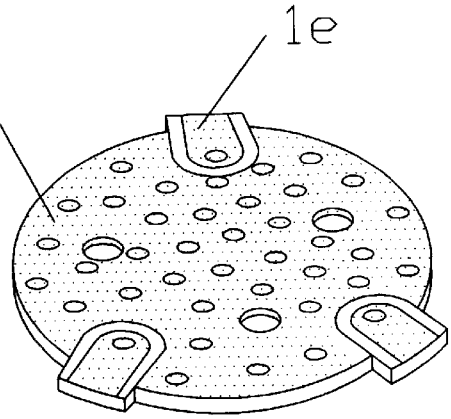
FIG. 2 shows the bottom side of the PCB shown on FIG. 1.

Referring to FIG. 1 the structure according to the present invention comprises of a PCB 1, housing 2, a stack 3 of components, a polygonal cover 4 and a locking cover 5. The PCB 1 is a two side copper clad dielectric, for example, of FR-4 type material. It includes three ports 1*a* for a circulator or two ports 1*a* for an isolator (this is the only difference between the two; all drawings and description hereafter are for the circulator version only, which represents the present invention most completely). The PCB 1 also comprises of at least three aligning holes 1*b* and plurality of the PTHs 1*c*. The copper clad (shown by dotted areas) is partially removed from the ports 1*a* forming the short copper pads 1*d* on the side facing the housing 2 and long (up to the edge of the ports 1*a*) copper pads 1*e* on the opposite side of the PCB 1 (see FIG. 2).

The housing 2 includes side portions 2*a* each having open flare slot 2*b* and a bottom portion with centering slots 2*c* and relief cutouts 2*d*. The side portions 2*a* are formed by bending the originally flat sheet metal work up to a perpendicular position relative to the bottom portion. In the formed housing the sides of the flare slots 2*b* that are closest to the bottom portion are parallel to that portion. Slots 2*c*, the openings 2*d* and the side portions 2*a* are equally spaced and symmetrically positioned relative to the central axis of the housing 2. Slots 2*c* have inner edges that are closest to the central axis of the housing 2. As it is clearly seen from FIG. 2, the whole housing 2 is formed of the sheet metal and may be made by stamping only, without using any secondary machining.

The stack 3 includes a set of components that is common for the circulators/isolators, such as a center conductor, two ferrites (one on each side of the center conductor), a magnet (s), pole pieces, temperature compensators, and the ground planes. Some of the components in the stack 3 may not be used or some additional components may be used in the specific device design depending on the given specifications. The only special requirement to the stack 3 in accordance to the present invention is that all its constituents should preferably have a circular shape and to be of the same diameter. This diameter should be equal to the diameter of the circle that is tangential to the inner edges of the slots 2*c* in the housing 2. This requirement is necessary for providing the centering and alignment of components of the stack 3 in the housing 2 (for lower IMD). However, components of different shape and size may also be used. In this case they should have holes or some constructive features for aligning with the inner edges of slots 2*c* (the example is hereafter in the description of a center conductor—FIG. 4). In the assembled device the cover 4 is disposed on the top of the stack. This cover is a polygonal flat element having at least as many sides as the housing 2. The cover 4 tightly fits to the inner portion of the housing 2, and, while being assembled with the stack 3, becomes positioned slightly above the lower sides of the flare slots 2*b*.

A locking cover 5 sits on the top of the cover 4 and locks the stack 3 in place by its teeth 5*a*. The teeth 5*a* are extended from the central portion of the cover 5 and equally spaced on its periphery. The slots 2*b* in the housing 2 accept the teeth 5*a*. The stack 3 and the cover 4 are tightened in the housing 2 when the cover 5 is turned. There are two holes 5*b* in the locking cover 5 to receive a rotation tool tips. Afterwards, the same holes 5*b* are used to secure cover 5 in place by dropping a solder or glue throughout them on the cover 4.

Figure 3:
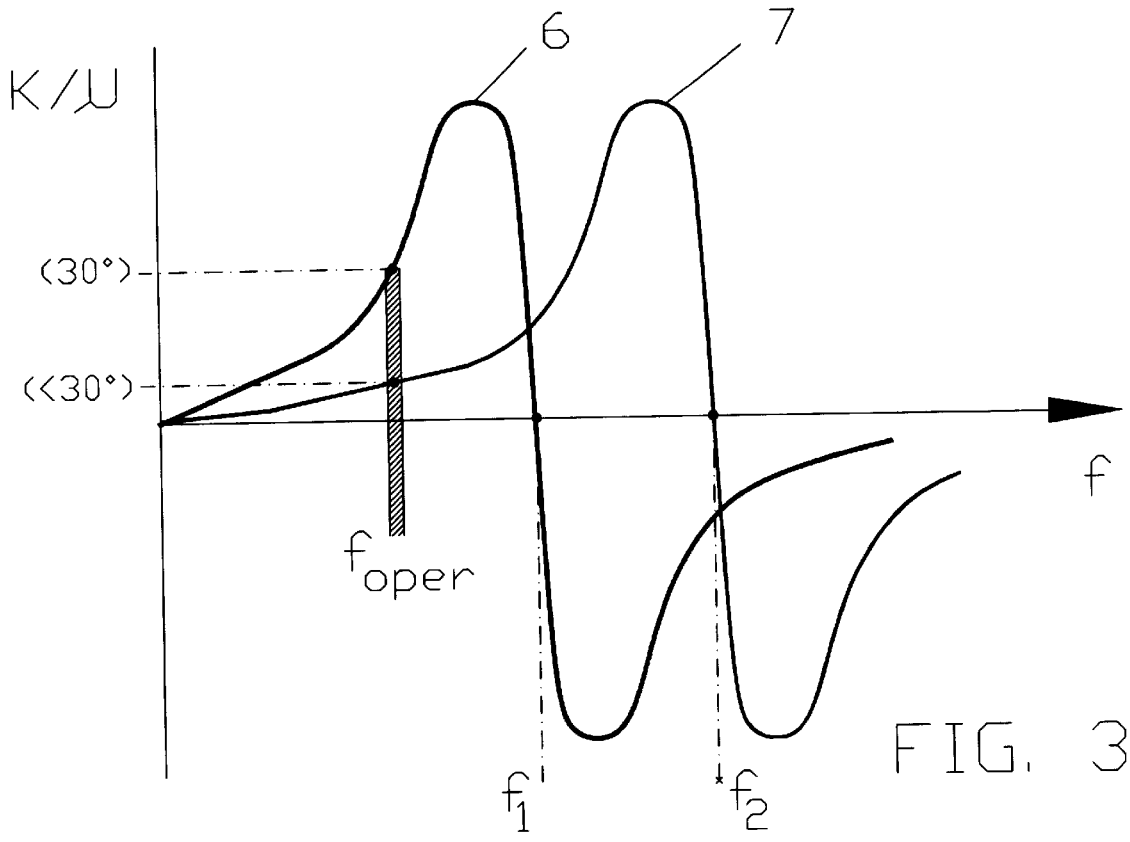
FIG. 3 graphically shows a function of the splitting factor versus frequency for two different values of the external magnetic field.

Referring to FIG. 3, the curve of the splitting factor $k/\mu$ versus frequency f is represented by the curve 6. The curve 6 shows that at the operation frequency range $f_{oper}$ the splitting factor gets the value providing the 30-degree rotation of the standing wave pattern required for the circulation action. The separation between the frequency of ferromagnetic resonance and the operation frequency is equal to $(f_1-f_{oper})$. In order to decrease the IMD, this difference should be kept as large as possible. This can be achieved by increasing the external biasing magnetic field from $H_2$ to $H_1$. This will shift the curve 6 into a new position 7 increasing the spacing to $(f_2-f_{oper})$. With this frequency shift, however, the splitting factor at a given operation frequency range $f_{oper}$ will be diminished and the required 30-degree rotation of the standing wave pattern will not be achieved.

Figure 4:
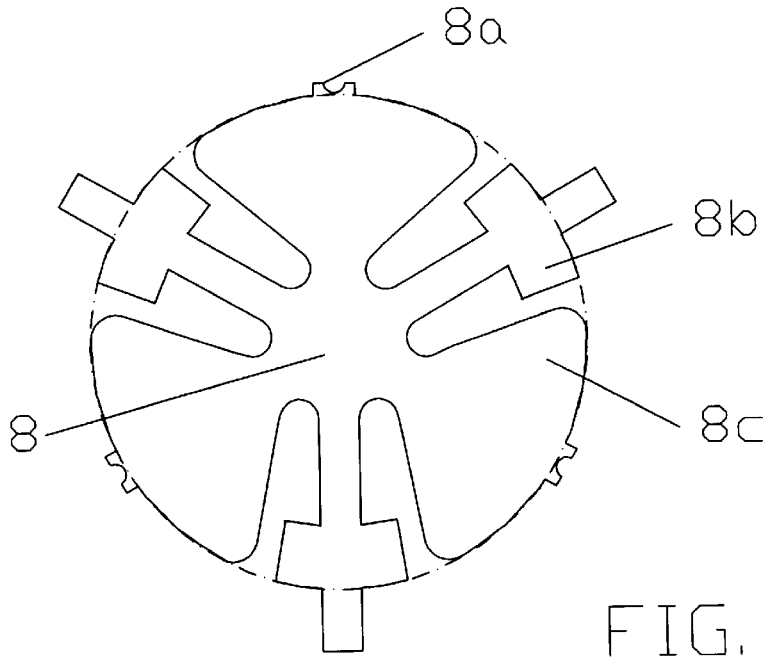
FIG. 4 shows the center conductor that is used in the structure according to the present invention.

It is known that the rotation angle depends on the level of electromagnetic coupling between the center conductor and the ferrites. It is also known that, because of the radial distribution of magnetic oscillation pattern, the coupling increases towards the peripheral areas of the ferrite discs. Referring to FIG. 4, the center conductor 8 includes transformer arms 8*b* (used for matching, for instance, to 50-Ohm line) and the tuning stub resonators 8*c*. In accordance with the present invention, the 30-degree rotation is restored by extending the tuning stub resonators at the enhanced magnetic field. Therefore, the lowest IMD, corresponding to the highest frequency offset, is achieved with the center conductor having the stub resonators 8*c* maximally extended toward the transformer arms 8*b* in azimutal direction, and toward the outline of the ferrites in the radial direction. With such design the 30-degree rotation of the standing wave pattern corresponding to the largest allowed frequency offset will be maintained. Also, each tuning stub resonator 8*c* of the center conductor 8 includes the aligning portion 8*a* having half-moon holes. The edge of the holes coincides with the inner edge 2*c* in the housing 2.

Figure 5:
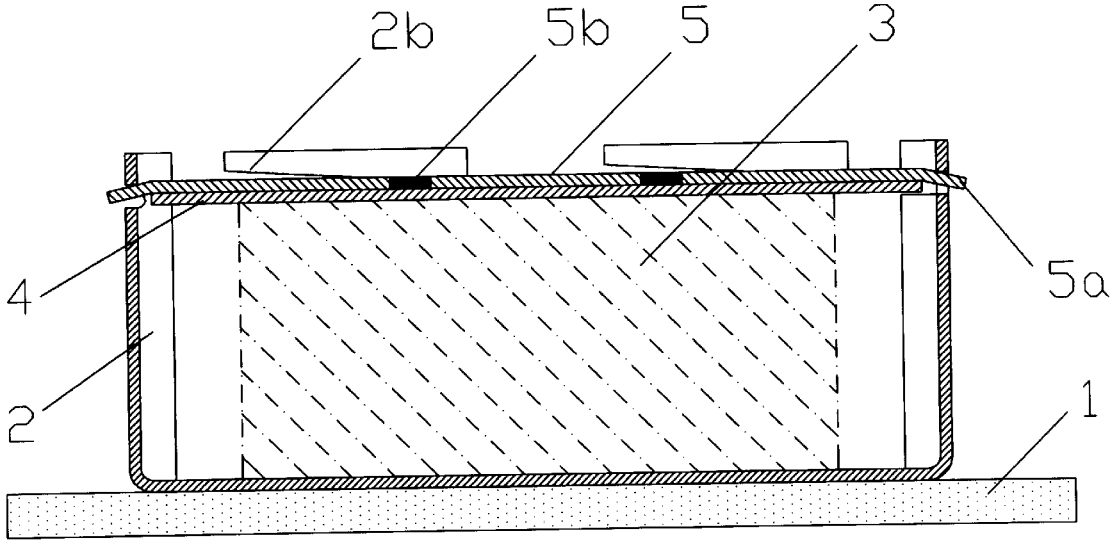
FIG. 5 shows a cross-sectional view of the assembled structure according to the present invention.

The cross-section view of the fully assembled unit is shown on FIG. 5. The PCB 1 is secured to the bottom of the housing 2, for example, by soldering. The stack 3 is disposed inside the housing 2 and is closed by the polygonal cover 4. The locking cover 5 is situated on a top of the cover 4 with the teeth 5*a* being received by the flare slots 2*b*. The stack 3 is held in place with the compression force resulting from turning (during the assembly process) the locking cover 5, which, accordingly, moves the teeth 5*a* along the slanted upper edges of flare slots 2*b* in the housing 2. After the cover 5 is tightened a drop of solder or glue is applied on the polygonal cover 4 throughout the holes 5*b*. This prevents the cover 5 from loosening because the polygonal cover 4 can not be turned in the polygonal housing 2.

Exact alignment of the stack 3 in the low IMD circulator/isolator is very important. For the structure in accordance to the present invention, a very simple procedure and inexpensive aligning fixture can be used to provide an accurate assembly. Referring to the FIG. 6, the aligning fixture is comprised of a base 9 and three pins 10. Location of the pins 10 relative to each other coincides with that of the holes 1*b* in the PCB 1, slots 2*c* in the housing 2, and half-moon holes 8*a* in the center conductor 8. The external diameter of the circular components of the stuck 3 should provide their disposition between three pins 10 with minimal radial play. The length of the pins 10 on the base 9 is slightly less than the height of the stack 3. Therefore, the cover 4 remains resting on the stack and does not touch the pins, thus providing the pressure to the stuck when is tightened.

Figure 6:
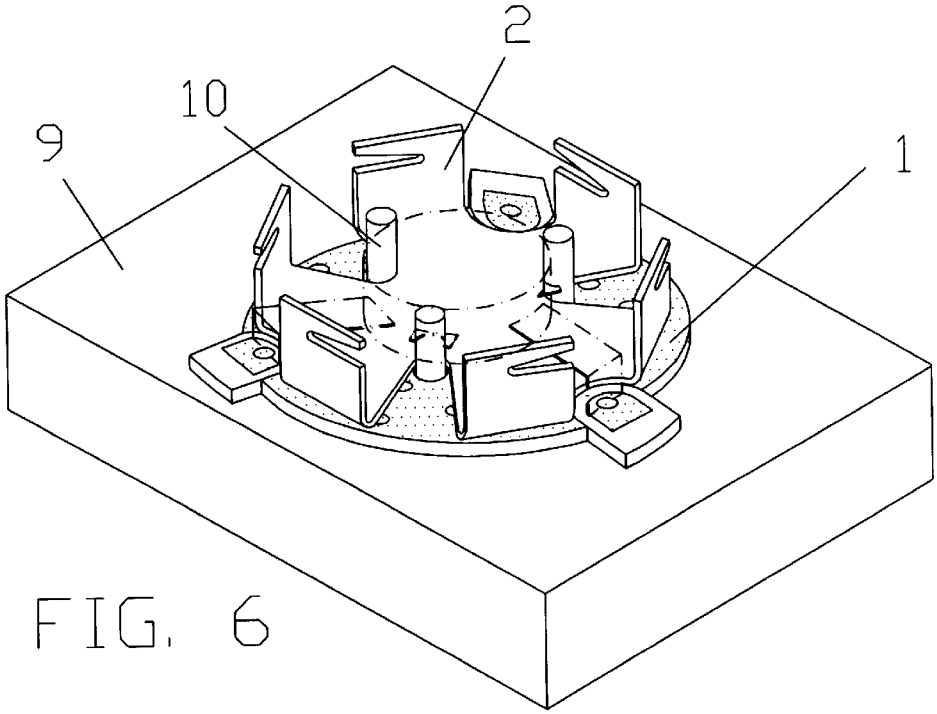
FIG. 6 shows a perspective view of a partially assembled structure according to the present invention that is installed in the assembly fixture.

End portions of the arms 8*b* of the center conductor 8 are bent down and soldered to the short pads 1*d* of the PCB 1, as shown on FIG. 6 with the dash-dot lines. Conductors from outside system where the unit is installed are made contact to the long pads 1*e* and, throughout the PTHs 1*c* located on the ports 1*a*, have connection with the short ports 1*d*and, in turn, with the center conductor 8 by means of its bent arms. The central portion of the PCB 1, shown on FIG. 2, makes contact with the ground in the outside system providing the grounding to the unit. During the installation of the unit in the system using pick-and-place method the live contacts and the grounding has to be provided in four areas simultaneously (in three ports and a grounding area). All electrical contacts of the unit according to the present invention belong to the same base surface (of the PCB 1). In such structure the specified flatness and coplanarity can be maintained along with the required quality of installation.

In operation, the temperature variation takes place. For the structure according to the present invention the difference in pertinent variation in size of the stack 3 and housing 2 is compensated by the spring action of the teeth 5*a* within a proportional segment of the stress-strain curve. The resistance of the cover 5 to bending in areas other than the teeth 5*a* is much greater. Therefore, during those variations the portion of the cover 5 that contacts the stack 3 stays substantially flat and continues to provide the uniform and actually unchanging pressure on the stack 3. Thus, a stabile performance of the unit, including a low IMD, is preserved over the broad range of temperature.

While the invention have been described in detail above, it is clear that there are variations and modifications to this disclosure here and above which will be readily apparent to one of ordinary skill in the art. To the extent that such variations and modifications of the present disclosure of a surface mountable low IMD circulator/isolator having a sheet metal housing with flare slots, a cover with teeth received by the slots in the housing, a PCB as a common mount base for live conductors and grounding, a center conductor with increased peripheral areas, and the procedure of aligning the whole structure by means of pins, such are deemed within the scope of the present invention.

I claim:

1. A structure for a passive low IMD microwave device, comprising:

a housing having a bottom portion with inside and outside surfaces, and plurality of side portions, wherein said bottom portion having polygonal shape with shallow and deep cutouts each in at least three comers of the polygon, said side portions are formed on sides of said polygon and bent up at substantially 90-degree angle to said bottom portion, each said side portion having a flare slot, all said slots located in common plane parallel to said bottom portion;

a stack of components including a center conductor with tuning stub resonators and transformer arms, and at least a magnet and two ferrites, that is disposed in said housing on said inside surface, wherein all the components of said stack having reference points to be aligned relative to each other and to said housing, and said tuning stub resonators of said center conductor having increased area that extend up to said ferrites outline in radial direction and up to maximal proximity to said transformer arms in azimutal direction;

a polygonal cover and a locking cover, wherein said polygonal cover is disposed on the said stack of components and having at least the same number of sides as said housing, and said locking cover is disposed on said polygonal cover and having teeth each is received by said flare slot, and at least two holes to receive tool tips;

a printed circuit board with printed through holes and top and bottom surfaces with metal clad, wherein input/output port pads are formed of said metal clad on both said surfaces with said pads within each said port being electrically connected to each other and to said transformer arms of said center conductor, said top surface clad of said printed circuit board is secured to said outside bottom surface of said housing by an electrically conductive material, said printed circuit board having at least three holes for alignment, location of said three holes coincides with that of said deep cutouts in said housing and location of said port pads coincides with that of said shallow cutouts in said housing.

2. A structure as recited in claim 1, wherein said shallow and deep cutouts in said bottom portion of said housing are symmetrically located in alternate pattern with said deep cutouts being large enough to open said three holes for alignment in said printed circuit boards, said shallow cutouts being large enough to open said ports, and said side portions of said housing are divided from each other by said shallow and deep cutouts.

3. A structure as recited in claim 1, wherein said flare slots in said housing each having upper and lower edge with said upper edge is slightly slanted relative to said inside surface of said bottom portion, and said lower edge is parallel to said inside surface and situated slightly below the top surface of said stack.

4. A structure as recited in claim 1, wherein said reference points of said stack of components, for said ferrites and said magnet, are taken along their outlines and, for said center conductor, are half-moon holes situated on periphery of each said tuning stub resonator, with said outlines and said half-moon holes are extended to the edges of said deep cutouts in said housing that is closest to the housing central axis.

5. A structure as recited in claim 1, wherein said polygonal cover having its outline size that is large enough to prevent rotation of said cover in said housing.

6. A structure as recited in claim 1, wherein said tuning stub resonator areas are large enough to provide 30-degree turn of the standing wave pattern in said ferrites with increased magnetic field and reduced IMD.

7. A method of assembly of the structure as recited in claim 1 comprising steps of forming and aligning said stack of components using a fixture, securing said stack in place in said housing, and making electrical contact of said transformer arms with said port pads on said printed circuit board, wherein said fixture having a base and at least three pins, said pins go through said aligning holes in said printed circuit board and through deep cutouts in said housing, said stack is disposed on said inside surface of said bottom portion of said housing and in the area inside said three pins, said polygonal cover is disposed on top of said stack, said teeth cover is disposed on top of said polygonal cover and being turned until said teeth are received by and stopped in said flare slots, said transformer arms are electrically connected with said port tabs on said top side, and said structure is removed from said pins.

8. A method as recited in claim 7, wherein said holes in said locking cover are used to turn said cover to its final position where it locks said stack of components in said housing, and also to secure said cover in said final position by dropping an adhesive solution through said two holes on said polygonal cover.

* * * * *